US009794716B2

(12) United States Patent
Seefeldt et al.

(10) Patent No.: US 9,794,716 B2
(45) Date of Patent: Oct. 17, 2017

(54) ADAPTIVE DIFFUSE SIGNAL GENERATION IN AN UPMIXER

(71) Applicant: DOLBY LABORATORIES LICENSING CORPORATION, San Francisco, CA (US)

(72) Inventors: Alan J. Seefeldt, Alameda, CA (US); Mark S. Vinton, San Francisco, CA (US); C. Phillip Brown, Castro Valley, CA (US)

(73) Assignee: Dolby Laboratories Licensing Corporation, San Francisco, CA (US)

( * ) Notice: Subject to any disclaimer, the term of this patent is extended or adjusted under 35 U.S.C. 154(b) by 0 days.

(21) Appl. No.: 15/025,074

(22) PCT Filed: Sep. 26, 2014

(86) PCT No.: PCT/US2014/057671

§ 371 (c)(1),
(2) Date: Mar. 25, 2016

(87) PCT Pub. No.: WO2015/050785

PCT Pub. Date: Apr. 9, 2015

(65) Prior Publication Data

US 2016/0241982 A1 Aug. 18, 2016

Related U.S. Application Data

(60) Provisional application No. 61/886,554, filed on Oct. 3, 2013, provisional application No. 61/907,890, filed on Nov. 22, 2013.

(51) Int. Cl.
*H04S 5/00* (2006.01)
*H04S 7/00* (2006.01)
(Continued)

(52) U.S. Cl.
CPC ..... *H04S 5/005* (2013.01); *G10L 19/008* (2013.01); *G10L 19/032* (2013.01); *H04S 7/30* (2013.01);
(Continued)

(58) Field of Classification Search
CPC ..... H04S 5/005; H04S 7/30; H04S 2400/01; H04S 2400/11; G10L 19/008; G10L 19/032
See application file for complete search history.

(56) References Cited

U.S. PATENT DOCUMENTS 7,970,144 B1 6/2011 Avendano
9,269,360 B2 2/2016 McGrath
(Continued)

FOREIGN PATENT DOCUMENTS

CN 101044794 9/2007
RU 2011104006 8/2012
(Continued)

OTHER PUBLICATIONS

Capobianco, J. et al "Dynamic Strategy for Window Splitting, Parameters Estimation and Interpolation in Spatial Parametric Audio Coders" IEEE International Conference on Acoustics, Speech and Signal Processing, pp. 397-400, Mar. 25-30, 2012.
(Continued)

*Primary Examiner* — Sonia Gay

(57) ABSTRACT

An audio processing system, such as an upmixer, may be capable of separating diffuse and non-diffuse portions of N input audio signals. The upmixer may be capable of detecting instances of transient audio signal conditions. During instances of transient audio signal conditions, the up-mixer may be capable of adding a signal-adaptive control to a diffuse signal expansion process in which M audio signals are output. The upmixer may vary the diffuse signal expan-
(Continued)

sion process over time such that during instances of transient audio signal conditions the diffuse portions of audio signals may be distributed substantially only to output channels spatially close to the input channels. During instances of non-transient audio signal conditions, the diffuse portions of audio signals may be distributed in a substantially uniform manner.

20 Claims, 11 Drawing Sheets

(51) Int. Cl.
*G10L 19/008* (2013.01)
*G10L 19/032* (2013.01)

(52) U.S. Cl.
CPC ..... *H04S 2400/01* (2013.01); *H04S 2400/11* (2013.01)

(56) References Cited

U.S. PATENT DOCUMENTS

2011/0081024 A1 4/2011 Soulodre
2011/0261967 A1* 10/2011 Walther ..... H04S 3/002 381/17
2016/0142845 A1* 5/2016 Dick ..... G10L 19/008 381/23

FOREIGN PATENT DOCUMENTS

| | | |
|---|---|---|
| WO | 2004/019656 | 3/2004 |
| WO | 2006/058590 | 6/2006 |
| WO | 2007/110101 | 10/2007 |
| WO | 2008/153944 | 12/2008 |
| WO | 2010/017967 | 2/2010 |
| WO | 2010/039646 | 4/2010 |
| WO | 2011/090834 | 7/2011 |
| WO | 2012/160472 | 11/2012 |

OTHER PUBLICATIONS

Gundry, Kenneth "A New Active Matrix Decoder for Surround Sound" AES 19th International Conference: Surround Sound-Techniques, Technology, and Perception, Jun. 1, 2001, pp. 1-9.

* cited by examiner

ADAPTIVE DIFFUSE SIGNAL GENERATION IN AN UPMIXER

CROSS REFERENCE TO RELATED APPLICATIONS

This application claims priority to U.S. Provisional Patent Application No. 61/886,554, filed on 3 Oct. 2013 and U.S. Provisional Patent Application No. 61/907,890, filed on 22 Nov. 2013, each of which is hereby incorporated by reference in its entirety.

TECHNICAL FIELD

This disclosure relates to processing audio data. In particular, this disclosure relates to processing audio data that includes both diffuse and directional audio signals during an upmixing process.

BACKGROUND

A process known as upmixing involves deriving some number M of audio signal channels from a smaller number N of audio signal channels. Some audio processing devices capable of upmixing (which may be referred to herein as "upmixers") may, for example, be able to output 3, 5, 7, 9 or more audio channels based on 2 input audio channels. Some upmixers may be able to analyze the phase and amplitude of two input signal channels to determine how the sound field they represent is intended to convey directional impressions to a listener. One example of such an upmixing device is the Dolby® Pro Logic® II decoder described in Gundry, "*A New Active Matrix Decoder for Surround Sound*" (19th AES Conference, May 2001).

The input audio signals may include diffuse and/or directional audio data. With regard to the directional audio data, an upmixer should be capable of generating output signals for multiple channels to provide the listener with the sensation of one or more aural components having apparent locations and/or directions. Some audio signals, such as those corresponding to gunshots, may be very directional. Diffuse audio signals, such as those corresponding to wind, rain, ambient noise, etc., may have little or no apparent directionality. When processing audio data that also includes diffuse audio signals, the listener should be provided with the perception of an enveloping diffuse sound field corresponding to the diffuse audio signals.

SUMMARY

Improved methods for processing diffuse audio signals are provided. Some implementations involve a method for deriving M diffuse audio signals from N audio signals for presentation of a diffuse sound field, wherein M is greater than N and is greater than 2. Each of the N audio signals may correspond to a spatial location.

The method may involve receiving the N audio signals, deriving diffuse portions of the N audio signals and detecting instances of transient audio signal conditions. The method may involve processing the diffuse portions of the N audio signals to derive the M diffuse audio signals. During instances of transient audio signal conditions, the processing may involve distributing the diffuse portions of the N audio signals in greater proportion to one or more of the M diffuse audio signals corresponding to spatial locations relatively nearer to the spatial locations of the N audio signals and in lesser proportion to one or more of the M diffuse audio signals corresponding to spatial locations relatively further from the spatial locations of the N audio signals.

The method may involve detecting instances of non-transient audio signal conditions. During instances of non-transient audio signal conditions the processing may involve distributing the diffuse portions of the N audio signals to the M diffuse audio signals in a substantially uniform manner.

The processing may involve applying a mixing matrix to the diffuse portions of the N audio signals to derive the M diffuse audio signals. The mixing matrix may be a variable distribution matrix. The variable distribution matrix may be derived from a non-transient matrix more suitable for use during non-transient audio signal conditions and from a transient matrix more suitable for use during transient audio signal conditions. In some implementations, the transient matrix may be derived from the non-transient matrix. Each element of the transient matrix may represent a scaling of a corresponding non-transient matrix element. In some instances, the scaling may be a function of a relationship between an input channel location and an output channel location.

The method may involve determining a transient control signal value. In some implementations, the variable distribution matrix may be derived by interpolating between the transient matrix and the non-transient matrix based, at least in part, on the transient control signal value. The transient control signal value may be time-varying. In some implementations, the transient control signal value may vary in a continuous manner from a minimum value to a maximum value. Alternatively, the transient control signal value may vary in a range of discrete values from a minimum value to a maximum value.

In some implementations, determining the variable distribution matrix may involve computing the variable distribution matrix according to the transient control signal value. However, determining the variable distribution matrix may involve retrieving a stored variable distribution matrix from a memory device.

The method may involve deriving the transient control signal value in response to the N audio signals. The method may involve transforming each of the N audio signals into B frequency bands and performing the deriving, detecting and processing separately for each of the B frequency bands. The method may involve panning non-diffuse portions of the N audio signals to form M non-diffuse audio signals and combining the M diffuse audio signals with the M non-diffuse audio signals to form M output audio signals.

In some implementations, the method may involve deriving K intermediate signals from the diffuse portions of the N audio signals, wherein K is greater than or equal to one and is less than or equal to M-N. Each intermediate audio signal may be psychoacoustically decorrelated with the diffuse portions of the N audio signals. If K is greater than one, each intermediate audio signal may be psychoacoustically decorrelated with all other intermediate audio signals. In some implementations, deriving the K intermediate signals may involve a decorrelation process that may include one or more of delays, all-pass filters, pseudo-random filters or reverberation algorithms. The M diffuse audio signals may be derived in response to the K intermediate signals as well as the N diffuse signals.

Some aspects of this disclosure may be implemented in an apparatus that includes an interface system and a logic system. The logic system may include one or more processors, such as general purpose single- or multi-chip processors, digital signal processors (DSP), application specific integrated circuits (ASICs), field programmable gate arrays (FPGAs) or other programmable logic devices, discrete gate or transistor logic, discrete hardware components and/or combinations thereof. The interface system may include at least one of a user interface or a network interface. The apparatus may include a memory system. The interface system may include at least one interface between the logic system and the memory system.

The logic system may be capable of receiving, via the interface system, N input audio signals. Each of the N audio signals may correspond to a spatial location. The logic system may be capable of deriving diffuse portions of the N audio signals and of detecting instances of transient audio signal conditions. The logic system may be capable of processing the diffuse portions of the N audio signals to derive M diffuse audio signals, wherein M is greater than N and is greater than 2. During instances of transient audio signal conditions the processing may involve distributing the diffuse portions of the N audio signals in greater proportion to one or more of the M diffuse audio signals corresponding to spatial locations relatively nearer to the spatial locations of the N audio signals and in lesser proportion to one or more of the M diffuse audio signals corresponding to spatial locations relatively further from the spatial locations of the N audio signals.

The logic system may be capable of detecting instances of non-transient audio signal conditions. During instances of non-transient audio signal conditions the processing may involve distributing the diffuse portions of the N audio signals to the M diffuse audio signals in a substantially uniform manner.

The processing may involve applying a mixing matrix to the diffuse portions of the N audio signals to derive the M diffuse audio signals. The mixing matrix may be a variable distribution matrix. The variable distribution matrix may be derived from a non-transient matrix more suitable for use during non-transient audio signal conditions and a transient matrix more suitable for use during transient audio signal conditions. In some implementations, the transient matrix may be derived from the non-transient matrix. Each element of the transient matrix may represent a scaling of a corresponding non-transient matrix element. In some examples, the scaling may be a function of a relationship between an input channel location and an output channel location.

The logic system may be capable of determining a transient control signal value. In some examples, the variable distribution matrix may be derived by interpolating between the transient matrix and the non-transient matrix based, at least in part, on the transient control signal value.

In some implementations, the logic system may be capable of transforming each of the N audio signals into B frequency bands. The logic system may be capable of performing the deriving, detecting and processing separately for each of the B frequency bands.

The logic system may be capable of panning non-diffuse portions of the N input audio signals to form M non-diffuse audio signals. The logic system may be capable of combining the M diffuse audio signals with the M non-diffuse audio signals to form M output audio signals.

The methods disclosed herein may be implemented via hardware, firmware, software stored in one or more non-transitory media, and/or combinations thereof. Details of one or more implementations of the subject matter described in this specification are set forth in the accompanying drawings and the description below. Other features, aspects, and advantages will become apparent from the description, the drawings, and the claims. Note that the relative dimensions of the following figures may not be drawn to scale.

BRIEF DESCRIPTION OF THE DRAWINGS

Like reference numbers and designations in the various drawings indicate like elements.

DESCRIPTION OF EXAMPLE EMBODIMENTS

The following description is directed to certain implementations for the purposes of describing some innovative aspects of this disclosure, as well as examples of contexts in which these innovative aspects may be implemented. However, the teachings herein can be applied in various different ways. For example, while various implementations are described in terms of particular playback environments, the teachings herein are widely applicable to other known playback environments, as well as playback environments that may be introduced in the future. Moreover, the described implementations may be implemented, at least in part, in various devices and systems as hardware, software, firmware, cloud-based systems, etc. Accordingly, the teachings of this disclosure are not intended to be limited to the implementations shown in the figures and/or described herein, but instead have wide applicability.

Figure 1:
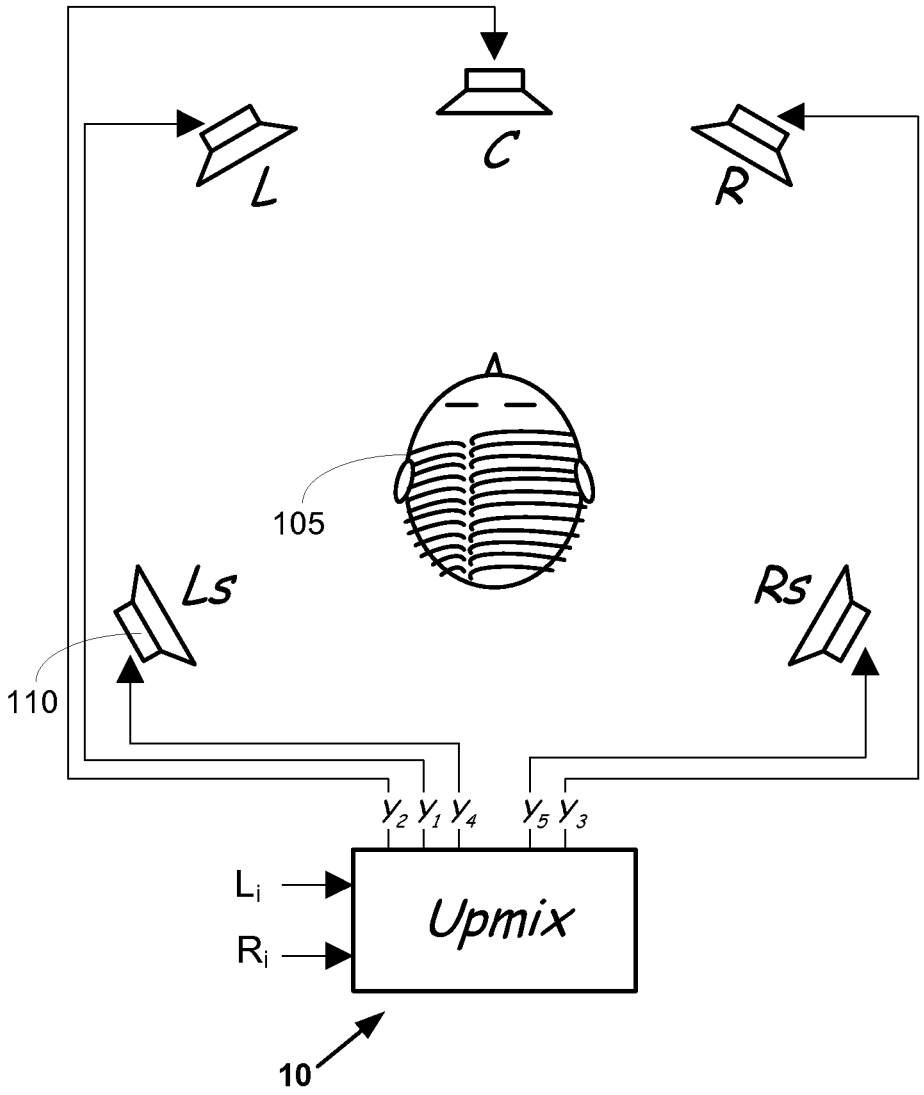
FIG. 1 shows an example of upmixing.

FIG. 1 shows an example of upmixing. In various examples described herein, the audio processing system 10 is capable of providing upmixer functionality and may also be referred to herein as an upmixer. In this example, the audio processing system 10 is capable of obtaining audio signals for five output channels designated as left (L), right (R), center (C), left-surround (LS) and right-surround (RS) by upmixing audio signals for two input channels, which are left-input ($L_i$) and right input ($R_i$) channels in this example. Some upmixers may be able to output different numbers of channels, e.g., 3, 7, 9 or more output channels, from 2 or a different number of input channels, e.g., 3, 5, or more input channels.

The input audio signals will generally include both diffuse and directional audio data. With regard to the directional audio data, the audio processing system 10 should be capable of generating directional output signals that provide the listener 105 with the sensation of one or more aural components having apparent locations and/or directions. For example, the audio processing system 10 may be capable of applying a panning algorithm to create a phantom image or apparent direction of sound between two speakers 110 by reproducing the same audio signal through each of the speakers 110.

With regard to the diffuse audio data, the audio processing system 10 should be capable of generating diffuse audio signals that provide the listener 105 with the perception of an enveloping diffuse sound field in which sound seems to be emanating from many (if not all) directions around the listener 105. A high-quality diffuse sound field typically cannot be created by simply reproducing the same audio signal through multiple speakers 110 located around a listener. The resulting sound field will generally have amplitudes that vary substantially at different listening locations, often changing by large amounts for very small changes in the location of the listener 105. Some positions within the listening area may seem devoid of sound for one ear but not the other. The resulting sound field may seem artificial. Therefore, some upmixers may decorrelate the diffuse portions of output signals, in order to create the impression that the diffuse portions of the audio signals are distributed uniformly around the listener 105. However, it has been observed that during "transient" or "percussive" moments of the input audio signal, the result of spreading the diffuse signals uniformly across all output channels may be a perceived "smearing" or "lack of punch" in the original transient. This may be especially problematic when several of the output channels are spatially distant from the original input channels. Such is the case, for example, with surround signals derived from standard stereo input.

In order to address the foregoing issues, some implementations disclosed herein provide an upmixer capable of separating diffuse and non-diffuse or "direct" portions of N input audio signals. The upmixer may be capable of detecting instances of transient audio signal conditions. During instances of transient audio signal conditions, the upmixer may be capable of adding a signal-adaptive control to a diffuse signal expansion process in which M audio signals are output. This disclosure assumes the number N is greater than or equal to one, the number M is greater than or equal to three, and the number M is greater than the number N.

According to some such implementations, the upmixer may vary the diffuse signal expansion process over time such that during instances of transient audio signal conditions the diffuse portions of audio signals may be distributed substantially only to output channels spatially close to the input channels. During instances of non-transient audio signal conditions, the diffuse portions of audio signals may be distributed in a substantially uniform manner. With this approach, the diffuse portions of audio signals remain in the spatial vicinity of the original audio signals during instances of transient audio signal conditions, in order to maintain the impact of the transients. During instances of non-transient audio signal conditions, the diffuse portions of audio signals may be spread in a substantially uniform manner, in order to maximize envelopment.

Figure 2:
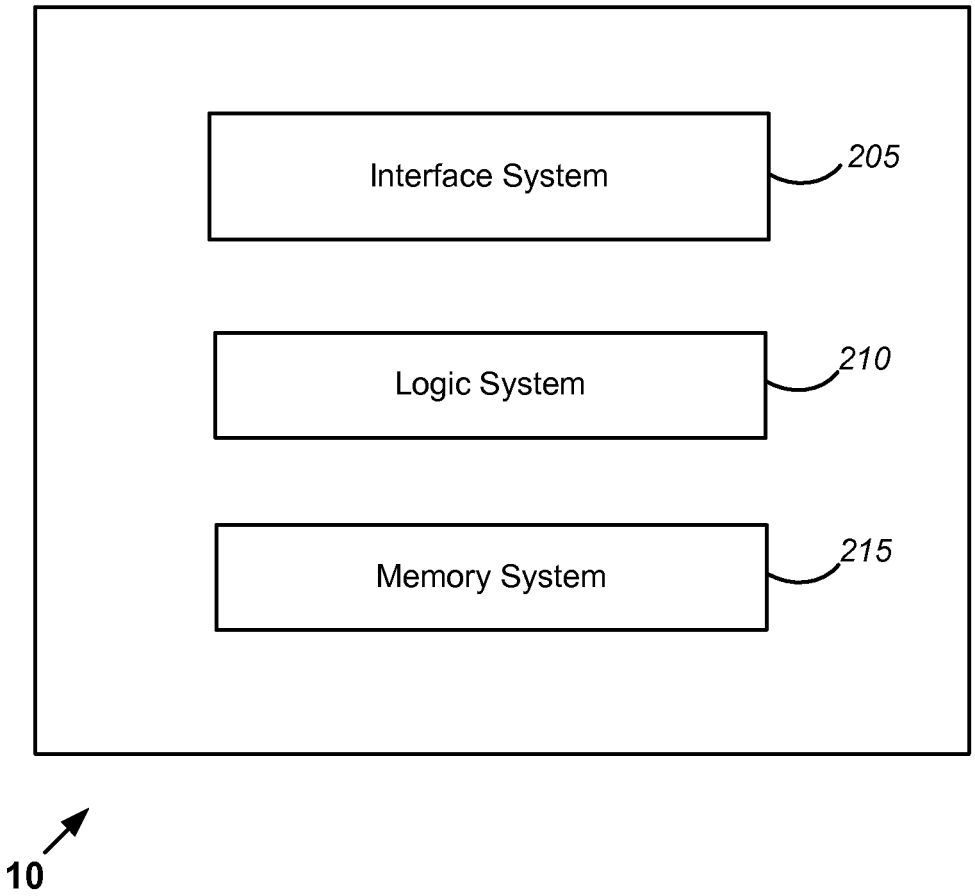
FIG. 2 shows an example of an audio processing system.

FIG. 2 shows an example of an audio processing system. In this implementation, the audio processing system 10 includes an interface system 205, a logic system 210 and a memory system 215. The interface system 205 may, for example, include one or more network interfaces, user interfaces, etc. The interface system 205 may include one or more universal serial bus (USB) interfaces or similar interfaces. The interface system 205 may include wireless or wired interfaces.

The logic system 210 system may include one or more processors, such as one or more general purpose single- or multi-chip processors, digital signal processors (DSPs), application specific integrated circuits (ASICs), field programmable gate arrays (FPGAs) or other programmable logic devices, discrete gate or transistor logic, discrete hardware components, or combinations thereof.

The memory system 215 may include one or more non-transitory media, such as random access memory (RAM) and/or read-only memory (ROM). The memory system 215 may include one or more other suitable types of non-transitory storage media, such as flash memory, one or more hard drives, etc. In some implementations, the interface system 205 may include at least one interface between the logic system 210 and the memory system 215.

Figure 3:
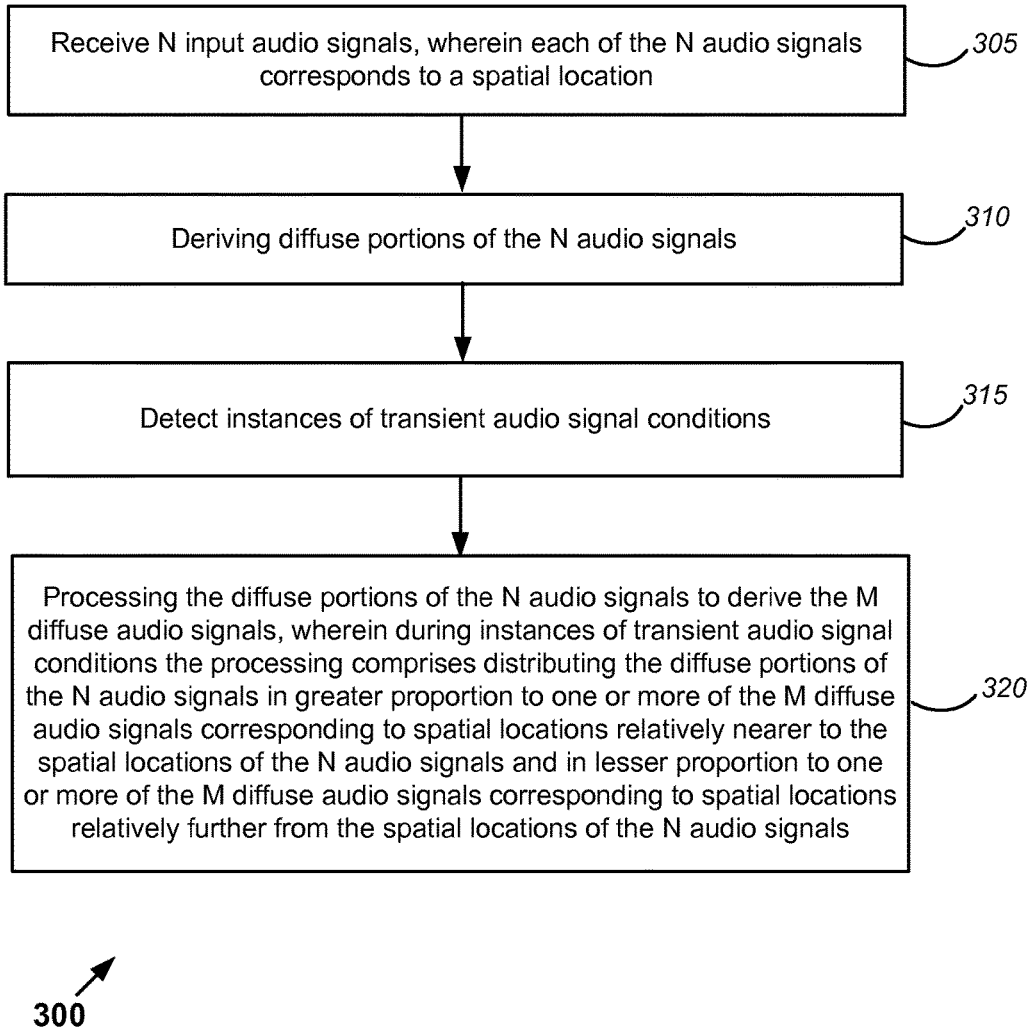
FIG. 3 is a flow diagram that outlines blocks of an audio processing method that may be performed by an audio processing system.

The audio processing system 10 may be capable of performing one or more of the various methods described herein. FIG. 3 is a flow diagram that outlines blocks of an audio processing method that may be performed by an audio processing system. Accordingly, the method 300 that is outlined in FIG. 3 will also be described with reference to the audio processing system 10 of FIG. 2. As with other methods described herein, the operations of method 300 are not necessarily performed in the order shown in FIG. 3. Moreover, method 300 (and other methods provided herein) may include more or fewer blocks than shown or described.

In this example, block 305 of FIG. 3 involves receiving N input audio signals. Each of the N audio signals may correspond to a spatial location. For example, for some implementations in which N=2, the spatial locations may correspond to the presumed locations of left and right input audio channels. In some implementations the logic system 210 may be capable of receiving, via the interface system 205, the N input audio signals.

In some implementations, the blocks of method 300 may be performed for each of a plurality of frequency bands. Accordingly, in some implementations block 305 may involve receiving audio data, corresponding to the N input audio signals, that has been decomposed into a plurality of frequency bands. In alternative implementations, block 305 may include a process of decomposing the input audio data into a plurality of frequency bands. For example, this process may involve some type of filterbank, such as a short-time Fourier transform (STFT) or Quadrature Minor Filterbank (QMF).

In this implementation, block 310 of FIG. 3 involves deriving diffuse portions of the N input audio signals. For example, the logic system 210 may be capable of separating the diffuse portions from the non-diffuse portions of the N input audio signals. Some examples of this process are provided below. At any given instant in time, the number of audio signals corresponding to the diffuse portions of the N input audio signals may be N, fewer than N or more than N.

The logic system 210 may be capable of decorrelating audio signals, at least in part. The numerical correlation of two signals can be calculated using a variety of known numerical algorithms. These algorithms yield a measure of numerical correlation called a correlation coefficient that varies between negative one and positive one. A correlation coefficient with a magnitude equal to or close to one indicates the two signals are closely related. A correlation coefficient with a magnitude equal to or close to zero indicates the two signals are generally independent of each other.

Psychoacoustical correlation refers to correlation properties of audio signals that exist across frequency subbands that have a so-called critical bandwidth. The frequencyresolving power of the human auditory system varies with frequency throughout the audio spectrum. The human ear can discern spectral components closer together in frequency at lower frequencies below about 500 Hz but not as close together as the frequency progresses upward to the limits of audibility. The width of this frequency resolution is referred to as a critical bandwidth, which varies with frequency.

Two audio signals are said to be psychoacoustically decorrelated with respect to each other if the average numerical correlation coefficient across psychoacoustic critical bandwidths is equal to or close to zero. Psychoacoustic decorrelation is achieved if the numerical correlation coefficient between two signals is equal to or close to zero at all frequencies. Psychoacoustic decorrelation can also be achieved even if the numerical correlation coefficient between two signals is not equal to or close to zero at all frequencies if the numerical correlation varies such that its average across each psychoacoustic critical band is less than half of the maximum correlation coefficient for any frequency within that critical band. Accordingly, psychoacoustic decorrelation is less stringent than numerical decorrelation in that two signals may be considered psychoacoustically decorrelated even if they have some degree of numerical correlation with each other.

The logic system 210 may be capable of deriving K intermediate signals from the diffuse portions of the N audio signals such that each of the K intermediate audio signals is psychoacoustically decorrelated with the diffuse portions of the N audio signals. If K is greater than one, each of the K intermediate audio signals may be psychoacoustically decorrelated with all other intermediate audio signals. Some examples are described below.

In some implementations, the logic system 210 also may be capable of performing the operations described in blocks 315 and 320 of FIG. 3. In this example, block 315 involves detecting instances of transient audio signal conditions. For example, block 315 may involve detecting the onset of an abrupt change in power, e.g., by determining whether a change in power over time has exceeded a predetermined threshold. Accordingly, transient detection may be referred to herein as onset detection. Examples are provided below with reference to the onset detection module 415 of FIGS. 4B and 6. Some such examples involve onset detection in a plurality of frequency bands. Therefore, in some instances, block 315 may involve detecting an instance of a transient audio signal in some, but not all, frequency bands.

Figure 5:
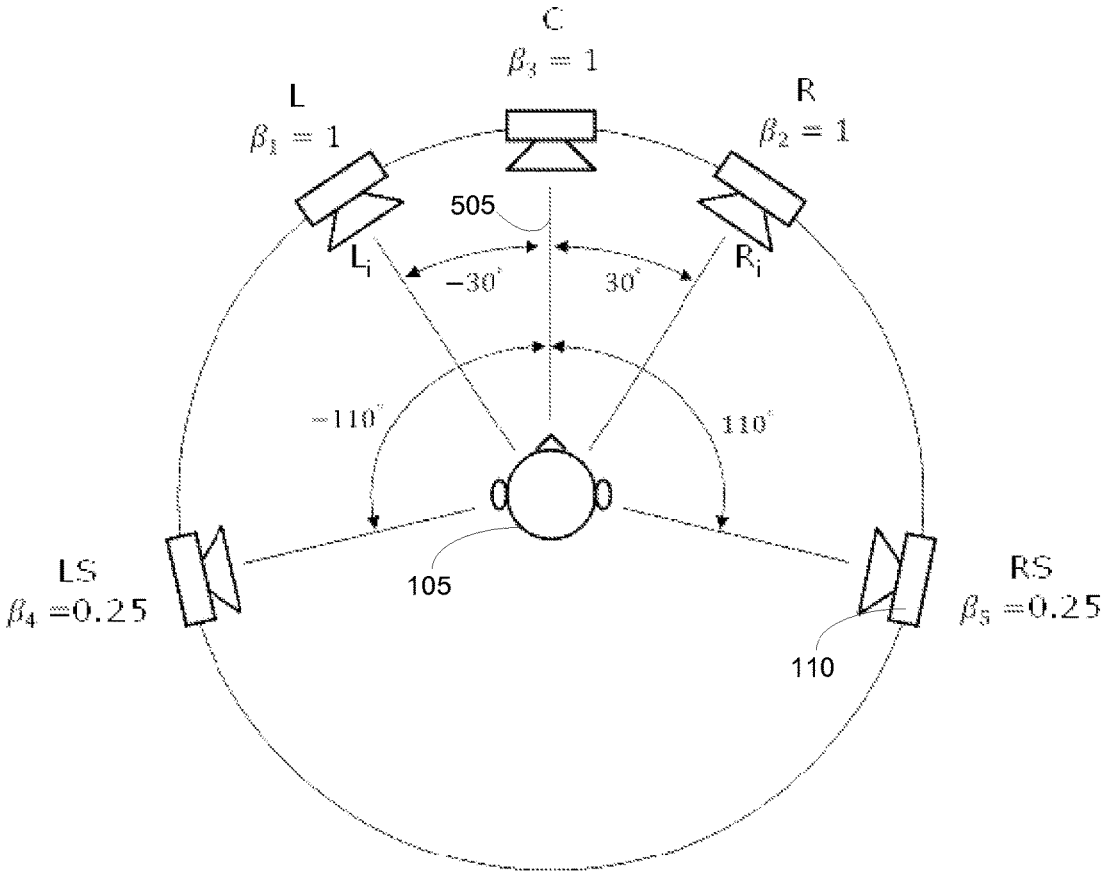
FIG. 5 shows examples of scaling factors for an implementation involving a stereo input signal and a five-channel output signal.

Here, block 320 involves processing the diffuse portions of the N audio signals to derive the M diffuse audio signals. During instances of transient audio signal conditions the processing of block 320 may involve distributing the diffuse portions of the N audio signals in greater proportion to one or more of the M diffuse audio signals corresponding to spatial locations relatively nearer to the spatial locations of the N audio signals. The processing of block 320 may involve distributing the diffuse portions of the N audio signals in lesser proportion to one or more of the M diffuse audio signals corresponding to spatial locations relatively further from the spatial locations of the N audio signals. One example is shown in FIG. 5 and is discussed below. In some such implementations, the processing of block 320 may involve mixing the diffuse portions of the N audio signals and the K intermediate audio signals to derive the M diffuse audio signals. During instances of transient audio signal conditions, the mixing process may involve distributing the diffuse portions of the audio signals primarily to output audio signals that correspond to output channels spatially close to the input channels. Some implementations also involve detecting instances of non-transient audio signal conditions. During instances of non-transient audio signal conditions, the mixing may involve distributing the diffuse signals to output channels to the M output audio signals in a substantially uniform manner.

In some implementations, the processing of block 320 may involve applying a mixing matrix to the diffuse portions of the N audio signals and the K intermediate audio signals to derive the M diffuse audio signals. For example, the mixing matrix may be a variable distribution matrix that is derived from a non-transient matrix more suitable for use during non-transient audio signal conditions and a transient matrix more suitable for use during transient audio signal conditions. In some implementations, the transient matrix may be derived from the non-transient matrix. According to some such implementations, each element of the transient matrix may represent a scaling of a corresponding non-transient matrix element. The scaling may, for example, be a function of a relationship between an input channel location and an output channel location.

More detailed examples of method 300 are provided below, including but not limited to examples of the transient matrix and the non-transient matrix. For example, various examples of blocks 315 and 320 are described below with reference to FIGS. 4B-5.

Figure 4A:
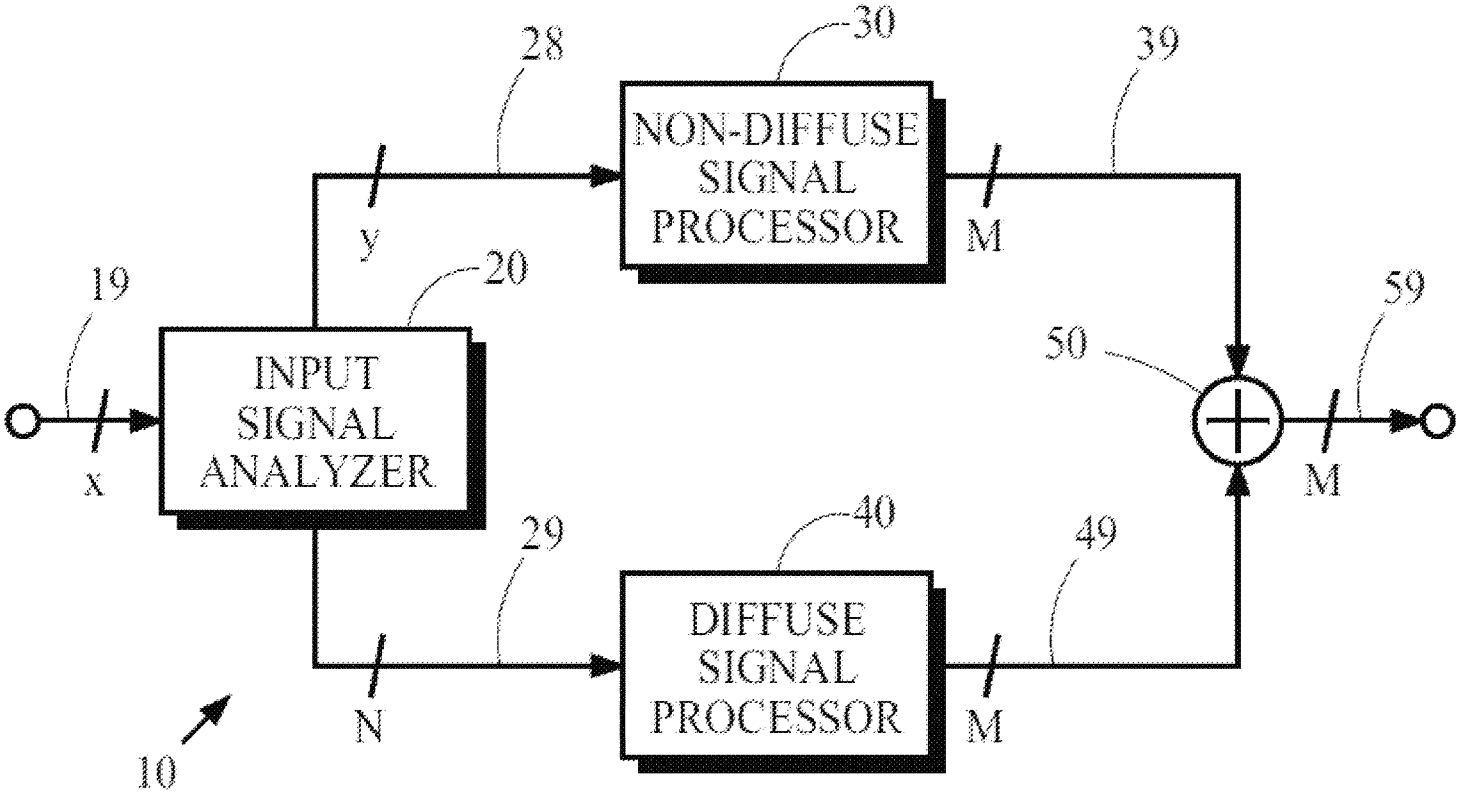
FIG. 4A is a block diagram that provides another example of an audio processing system.

FIG. 4A is a block diagram that provides another example of an audio processing system. The blocks of FIG. 4A may, for example, be implemented by the logic system 210 of FIG. 2. In some implementations, the blocks of FIG. 4A may be implemented, at least in part, by software stored in a non-transitory medium. In this implementation, the audio processing system 10 is capable of receiving audio signals for one or more input channels from the signal path 19 and of generating audio signals along the signal path 59 for a plurality of output channels. The small line that crosses the signal path 19, as well as the small lines that cross the other signal paths, indicate that these signal paths are capable of carrying signals for one or more channels. The symbols N and M immediately below the small crossing lines indicate that the various signal paths are capable of carrying signals for N and M channels, respectively. The symbols "x" and "y" immediately below some of the small crossing lines indicate that the respective signal paths are capable of carrying an unspecified number of signals.

In the audio processing system 10, the input signal analyzer 20 is capable of receiving audio signals for one or more input channels from the signal path 19 and of determining what portions of the input audio signals represent a diffuse sound field and what portions of the input audio signals represent a sound field that is not diffuse. The input signal analyzer 20 is capable of passing the portions of the input audio signals that are deemed to represent a non-diffuse sound field along the signal path 28 to the non-diffuse signal processor 30. Here, the non-diffuse signal processor 30 is capable of generating a set of M audio signals that are intended to reproduce the non-diffuse sound field through a plurality of acoustic transducers such as loud speakers and of transmitting these audio signals along the signal path 39. One example of an upmixing device that is capable of performing this type of processing is a Dolby Pro Logic II™ decoder.

In this example, the input signal analyzer 20 is capable of transmitting the portions of the input audio signals corresponding to a diffuse sound field along the signal path 29 to the diffuse signal processor 40. Here, the diffuse signal processor 40 is capable of generating, along the signal path 49, a set of M audio signals corresponding to a diffuse sound field. The present disclosure provides various examples of audio processing that may be performed by the diffuse signal processor 40.

In this embodiment, the summing component 50 is capable of combining each of the M audio signals from the non-diffuse signal processor 30 with a respective one of the M audio signals from the diffuse signal processor 40 to generate an audio signal for a respective one of the M output channels. The audio signal for each output channel may be intended to drive an acoustic transducer, such as a speaker.

Various implementations described herein are directed toward developing and using a system of mixing equations to generate a set of audio signals that can represent a diffuse sound field. In some implementations, the mixing equations may be linear mixing equations. The mixing equations may be used in the diffuse signal processor 40, for example.

However, the audio processing system 10 is merely one example of how the present disclosure may be implemented. The present disclosure may be implemented in other devices that may differ in function or structure from those shown and described herein. For example, the signals representing both the diffuse and non-diffuse portions of a sound field may be processed by a single component. Some implementations for a distinct diffuse signal processor 40 are described below that mix signals according to a system of linear equations defined by a matrix. Various parts of the processes for both the diffuse signal processor 40 and the non-diffuse signal processor 30 may be implemented by a system of linear equations defined by a single matrix. Furthermore, aspects of the present invention may be incorporated into a device without also incorporating the input signal analyzer 20, the non-diffuse signal processor 30 or the summing component 50.

Figure 4B:
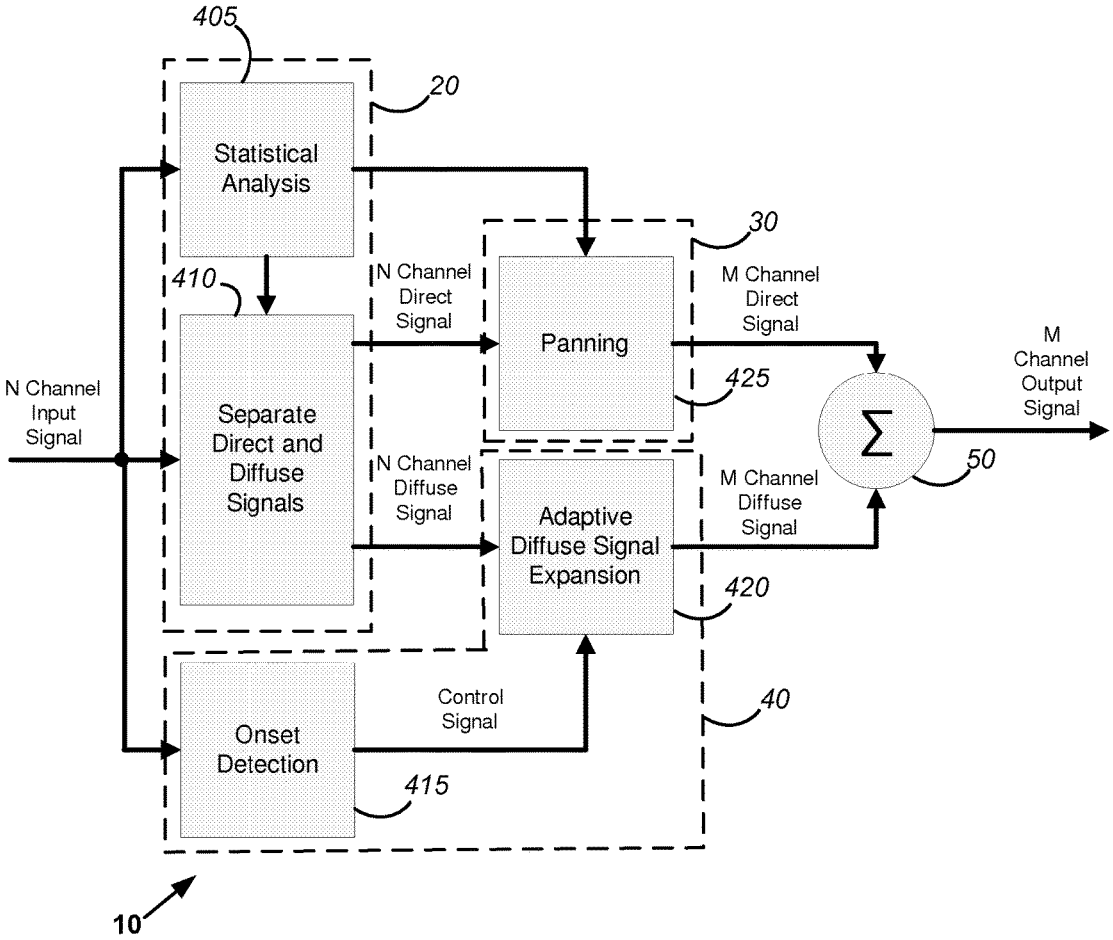
FIG. 4B is a block diagram that provides another example of an audio processing system.

FIG. 4B is a block diagram that provides another example of an audio processing system. The blocks of FIG. 4B include more detailed examples of the blocks of FIG. 4A, according to some implementations. Accordingly, the blocks of FIG. 4B may, for example, be implemented by the logic system 210 of FIG. 2. In some implementations, the blocks of FIG. 4B may be implemented, at least in part, by software stored in a non-transitory medium.

Here, the input signal analyzer 20 includes a statistical analysis module 405 and a signal separating module 410. In this implementation, the diffuse signal processor 40 includes an onset detection module 415 and an adaptive diffuse signal expansion module 420. However, in alternative implementations, the functionality of the blocks shown in FIG. 4B may be distributed between different modules. For example, in some implementations the input signal analyzer 20 may perform the functions of the onset detection module 415.

The statistical analysis module 405 may be capable of performing various types of analyses on the N channel input audio signal. For example, if N=2, the statistical analysis module 405 may be capable of computing an estimate of the sum of the power in the left and right signals, the difference of the power in the left and right signals, and the real part of the cross correlation between the input left and right signals. Each statistical estimate may be accumulated over a time block and over a frequency band. The statistical estimate may be smoothed over time. For example, the statistical estimate may be smoothed by using a frequency-dependent leaky integrator, such as a first order infinite impulse response (IIR) filter. The statistical analysis module 405 may provide statistical analysis data to other modules, e.g., the signal separating module 410 and/or the panning module 425.

In this implementation, the signal separating module 410 is capable of separating the diffuse portions of the N input audio signals from non-diffuse or "direct" portions of the N input audio signals. The signal separating module 410 may, for example, determine that highly correlated portions of the N input audio signals correspond with non-diffuse audio signals. For example, if N=2, the signal separating module 410 may determine, based on statistical analysis data from the statistical analysis module 405, that the non-diffuse audio signal is a highly-correlated portion of the audio signal that is contained in both the left and right inputs.

Based on the same (or similar) statistical analysis data, the panning module 425 may determine that this portion of the audio signal should be steered to an appropriate location, e.g., as representing a localized audio source, such as a point source. The panning module 425, or another module of the non-diffuse signal processor 30, may be capable of producing M non-diffuse audio signals corresponding with the non-diffuse portions of the N input audio signals. The non-diffuse signal processor 30 may be capable of providing the M non-diffuse audio signals to the summing component 50.

The signal separating module 410 may, in some examples, determine that the diffuse portions of the input audio signals are those portions of the signal that remain after the non-diffuse portions have been isolated. For example, the signal separating module 410 may determine the diffuse portions of the audio signal by computing the difference between the input audio signal and the non-diffuse portion of the audio signal. The signal separating module 410 may provide the diffuse portions of the audio signal to the adaptive diffuse signal expansion module 420.

Here, the onset detection module 415 is capable of detecting instances of transient audio signal conditions. In this example, the onset detection module 415 is capable of determining a transient control signal value and of providing the transient control signal value to the adaptive diffuse signal expansion module 420. In some instances, the onset detection module 415 may be capable of determining whether an audio signal in each of a plurality of frequency bands includes a transient audio signal. Accordingly, in some instances the transient control signal value determined by the onset detection module 415 and provided to the adaptive diffuse signal expansion module 420 may be specific to one or more particular frequency bands, but not to all frequency bands.

In this implementation, the adaptive diffuse signal expansion module 420 is capable of deriving K intermediate signals from the diffuse portions of the N input audio signals. In some implementations, each intermediate audio signal may be psychoacoustically decorrelated with the diffuse portions of the N input audio signals. If K is greater than one, each intermediate audio signal may be psychoacoustically decorrelated with all other intermediate audio signals.

In this implementation, the adaptive diffuse signal expansion module 420 is capable of mixing diffuse portions of the N audio signals and the K intermediate audio signals to derive M diffuse audio signals, wherein M is greater than N and is greater than 2. In this example, K is greater than or equal to one and is less than or equal to M−N. During instances of transient audio signal conditions (determined, at least in part, according to the transient control signal value received from the onset detection module 415), the mixing process may involve distributing the diffuse portions of the N audio signals in greater proportion to one or more of the M diffuse audio signals corresponding to spatial locations relatively nearer to spatial locations of the N audio signals, e.g., nearer to presumed spatial locations of the N input channels. During instances of transient audio signal conditions, the mixing process may involve distributing the diffuse portions of the N audio signals in lesser proportion to one or more of the M diffuse audio signals corresponding to spatial locations relatively further from the spatial locations of the N audio signals. However, during instances of non-transient audio signal conditions, the mixing process may involve distributing the diffuse portions of the N audio signals to the M diffuse audio signals in a substantially uniform manner.

In some implementations, the adaptive diffuse signal expansion module 420 may be capable of applying a mixing matrix to the diffuse portions of the N audio signals and the K intermediate audio signals to derive the M diffuse audio signals. The adaptive diffuse signal expansion module 420 may be capable of providing the M diffuse audio signals to the summing component 50, which may be capable of combining the M diffuse audio signals with M non-diffuse audio signals, to form M output audio signals.

According to some such implementations, the mixing matrix applied by the adaptive diffuse signal expansion module 420 may be a variable distribution matrix that is derived from a non-transient matrix more suitable for use during non-transient audio signal conditions and a transient matrix more suitable for use during transient audio signal conditions. Various examples of determining transient matrices and non-transient matrices are provided below.

According to some such implementations, the transient matrix may be derived from the non-transient matrix. For example, each element of the transient matrix may represent a scaling of a corresponding non-transient matrix element. The scaling may, for example, be a function of a relationship between an input channel location and an output channel location. In some implementations, the adaptive diffuse signal expansion module 420 may be capable of interpolating between the transient matrix and the non-transient matrix based, at least in part, on a transient control signal value received from the onset detection module 415.

In some implementations, the adaptive diffuse signal expansion module 420 may be capable of computing the variable distribution matrix according to the transient control signal value. Some examples are provided below. However, in alternative implementations, the adaptive diffuse signal expansion module 420 may be capable of determining the variable distribution matrix by retrieving a stored variable distribution matrix from a memory device. For example, the adaptive diffuse signal expansion module 420 may be capable of determining which variable distribution matrix of a plurality of stored variable distribution matrices to retrieve from the memory device, based at least in part on the transient control signal value.

The transient control signal value will generally be time-varying. In some implementations, the transient control signal value may vary in a continuous manner from a minimum value to a maximum value. However, in alternative implementations, the transient control signal value may vary in a range of discrete values from a minimum value to a maximum value.

Let c(t) represent a time-varying transient control signal which has transient control signal values that vary continuously between the values zero and one. In this example, a transient control signal value of one indicates that the corresponding audio signal is transient-like in nature, and a transient control signal value of zero indicates that the corresponding audio signal is non-transient. Let T represent a "transient matrix" more suitable for use during instances of transient audio signal conditions, and let C represent a "non-transient matrix" more suitable for use during instances of non-transient audio signal conditions. Various examples of the non-transient matrix are described below. A non-normalized version of the variable distribution matrix D(t) may be computed as a power-preserving interpolation between the transient and non-transient matrices:

$$D(t)=c(t)T+\sqrt{1-c^2(t)}C \quad \text{(Equation 1)}$$

In order to maintain the relative energy of the M-channel diffuse output signal, this non-normalized matrix may then be normalized such that the sum of the squares of all elements of the matrix is equal to one:

$$\overline{D}(t) = \alpha(t)D(t) \quad \text{(Equation 2a)}$$

$$\alpha(t) = \sqrt{\frac{1}{\Sigma_{i=1}^{M}\Sigma_{j=1}^{N+K}D_{ij}^2(t)}} \quad \text{(Equation 2b)}$$

In Equation 2b, $D_{ij}(t)$ represents the element in the ith row and jth column of the non-normalized distribution matrix D(t). The element in the ith row and jth column of the distribution matrix specifies the amount that the jth input diffuse channel contributes to the ith output diffuse channel. The adaptive diffuse signal expansion module 420 may then apply the normalized distribution matrix $\overline{D}(t)$ to the N+K-channel diffuse input signal to generate the M-channel diffuse output signal.

However, in alternative implementations, the adaptive diffuse signal expansion module 420 may retrieve the normalized distribution matrix $\overline{D}(t)$ from a stored plurality of normalized distribution matrices $\overline{D}(t)$ (e.g., from a lookup table) instead of re-computing the normalized distribution matrix $\overline{D}(t)$ for each new time instance. For example, each of the normalized distribution matrices $\overline{D}(t)$ may have been previously computed for a corresponding value (or range of values) of the control signal c(t).

As noted above, the transient matrix T may be computed as a function of C along with the assumed spatial locations of the input and output channels. Specifically, each element of the transient matrix may be computed as a scaling of the corresponding non-transient matrix element. The scaling may, for example, be a function of the relationship of the corresponding output channel's location to that of the input channels. Recognizing that the element in the ith row and jth column of the distribution matrix specifies the amount that the jth input diffuse channel contributes to the ith output diffuse channel, each element of the transient matrix T may be computed as $$T_{ij}=\beta_i C_{ij} \quad \text{(Equation 3)}$$

In Equation 3, the scaling factor $\beta_i$ is computed based on the location of the ith channel of the M-channel output signal with respect to the locations of the N channels of the input signal. In general, for output channels close to the input channels, it may be desirable for $\beta_i$ to be close to one. As an output channel becomes spatially more distant from the input channels, it may be desirable for to become smaller.

FIG. 5 shows examples of scaling factors for an implementation involving a stereo input signal and a five-channel output signal. In this example, the input channels are designated $L_i$ and $R_i$, and the output channels are designated L, R, C, LS and RS. The assumed channel locations and example values of the scaling factor $\beta_i$ are depicted in FIG.

5. We see that for output channels L, R, and C, which are spatially close to input channels L, and $R_i$, the scaling factor $\beta_i$ has been set to one in this example. For output channels LS and RS, which are assumed to be spatially more distant from input channels $L_i$ and $R_i$, the scaling factor $\beta_i$ has been set to 0.25 in this example.

Assuming that the input channels $L_i$ and $R_i$ are located at minus and plus 30 degrees from the median plane 505, then according to some such implementations $\beta_i$=0.25 if the absolute value of the angle of the output channel from the median plane 505 is larger than 45 degrees. Otherwise $\beta_i$=1. This example provides one simple strategy for generating the scaling factors. However, many other strategies are possible. For example, in some implementations the scaling factor $\beta_i$ may have a different minimum value and/or may have a range of values between the minimum and maximum values.

Figure 6:
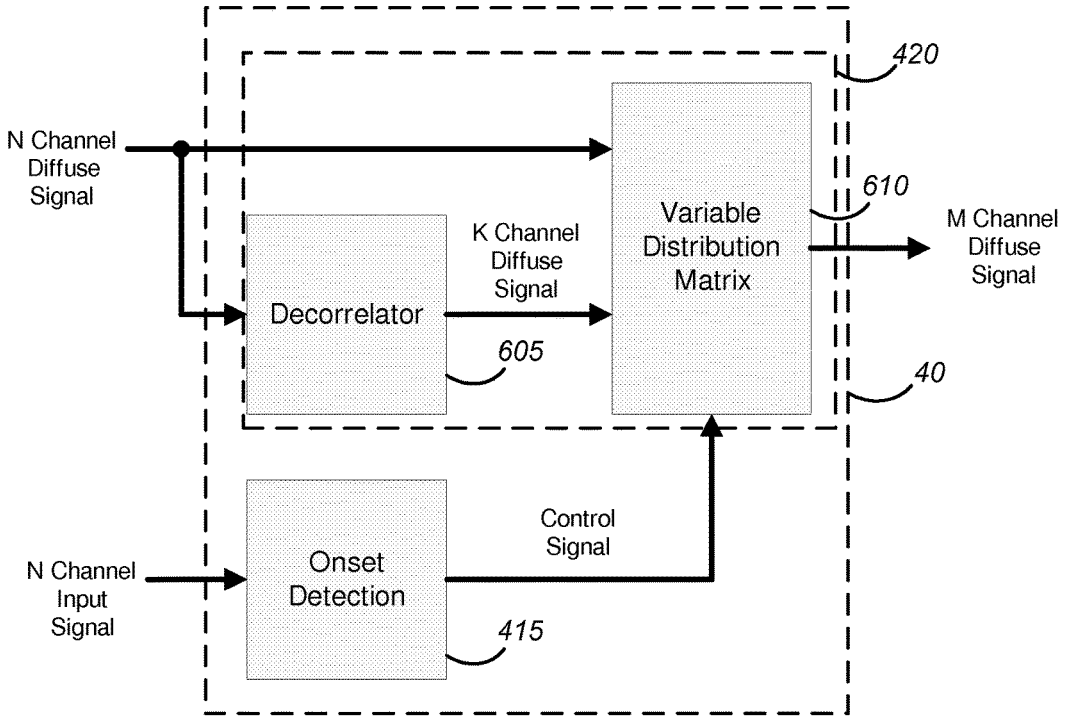
FIG. 6 is a block diagram that shows further details of a diffuse signal processor according to one example.

FIG. 6 is a block diagram that shows further details of a diffuse signal processor according to one example. In this implementation, the adaptive diffuse signal expansion module 420 of the diffuse signal processor 40 includes a decorrelator module 605 and a variable distribution matrix module 610. In this example, the decorrelator module 605 is capable of decorrelating N channels of diffuse audio signals and producing K substantially orthogonal output channels to the variable distribution matrix module 610. As used herein, two vectors are considered to be "substantially orthogonal" to one another if their dot product is less than 35% of a product of their magnitudes. This corresponds to an angle between vectors from about seventy degrees to about 110 degrees.

The variable distribution matrix module 610 is capable of determining and applying an appropriate variable distribution matrix, based at least in part on a transient control signal value received from the onset detection module 415. In some implementations, the variable distribution matrix module 610 may be capable of calculating the variable distribution matrix, based at least in part on the transient control signal value. In alternative implementations, the variable distribution matrix module 610 may be capable of selecting a stored variable distribution matrix, based at least in part on the transient control signal value, and of retrieving the selected variable distribution matrix from the memory device.

While some implementations may operate in a wideband manner, it may be preferable for the adaptive diffuse signal expansion module 420 to operate on a multitude of frequency bands. This way, frequency bands not associated with a transient may be allowed to remain evenly distributed across all channels, thereby maximizing the amount of envelopment while preserving the impact of transients in the appropriate frequency bands. To achieve this, the audio processing system 10 may be capable of decomposing the input audio signal into a multitude of frequency bands.

For example, the audio processing system 10 may be capable of applying some type of filterbank, such as a short-time Fourier transform (STFT) or Quadrature Minor Filterbank (QMF). For each band of the filterbank, an instance of one or more components of the audio processing system 10 (e.g., as shown in FIG. 4B or FIG. 6) may be run in parallel. For example, an instance of the adaptive diffuse signal expansion module 420 may be run for each band of the filterbank.

According to some such implementations, the onset detection module 415 may be capable of producing a multiband transient control signal that indicates the transient-like nature of audio signals in each frequency band. In some implementations, the onset detection module 415 may be capable of detecting increases in energy across time in each band and generating a transient control signal corresponding to such energy increases. Such a control signal may be generated from the time-varying energy in each frequency band, down-mixed across all input channels. Letting E(b,t) represent this energy at time t in frequency band b, a time-smoothed version of this energy may first be computed using a one-pole smoother in one example:

$$E_s(b,t)=\alpha_s E_s(b,t-1)+(1-\alpha_s)E(b,t) \quad \text{(Equation 4)}$$

In one example, the smoothing coefficient $\alpha_s$ may be chosen to yield a half-decay time of approximately 200 ms. However, other smoothing coefficient values may provide satisfactory results. Next, a raw transient signal o(b, t) may be computed by subtracting the dB value of the smoothed energy at a previous time instant from the dB value of the non-smoothed energy at the current time instant:

$$o(b,t)=10\log_{10}(E(b,t))-10\log_{10}(E_s(b,t-1)) \quad \text{(Equation 5)}$$

This raw transient signal may then be normalized to lie between zero and one using transient normalization bounds $o_{low}$ and $o_{high}$.

$$\bar{o}(b,t)=\begin{cases} 1, & o(b,t)\geq o_{high} \\ \dfrac{o(b,t)-o_{low}}{o_{high}-o_{low}}, & o_{low}<o(b,t)<o_{high} \\ 0, & o(b,t)\leq o_{low} \end{cases} \quad \text{(Equation 6)}$$

Values of $o_{low}$=3 dB and $o_{high}$=9 dB have been found to work well. However, other values may produce acceptable results. Finally, the transient control signal c(b, t) may be computed. In one example, the transient control signal c(b, t) may be computed by smoothing the normalized transient signal with an infinite attack, slow release one-pole smoothing filter:

$$c(b,t)=\begin{cases} \bar{o}(b,t), & \bar{o}(b,t)\geq c(b,t-1) \\ \alpha_r c(b,t-1), & \text{otherwise} \end{cases} \quad \text{(Equation 7)}$$

A release coefficient $\alpha_r$ yielding a half-decay time of approximately 200 ms has been found to work well. However, other release coefficient values may provide satisfactory results. In this example, the resulting transient control signal c(b, t) of each frequency band instantly rises to one when the energy in that band exhibits a significant rise, and then gradually decreases to zero as the signal energy decreases. The subsequent proportional variation of the distribution matrix in each band yields a perceptually transparent modulation of the diffuse sound field, which maintains both the impact of transients and the overall envelopment.

Following are some examples of forming and applying the non-transient matrix C, as well as of related methods and processes.

First Derivation Method

Referring again to FIG. 4A, in this example the diffuse signal processor 40 generates along the path 49 a set of M signals by mixing the N channels of audio signals received from the path 29 according to a system of linear equations. For ease of description in the following discussion, the portions of the N channels of audio signals received from the path 29 are referred to as intermediate input signals and the M channels of intermediate signals generated along the path 49 are referred to as intermediate output signals. This mixing operation includes the use of a system of linear equations that may be represented by a matrix multiplication, for example as shown below:

$$\vec{Y} = \begin{bmatrix} Y_1 \\ \vdots \\ Y_M \end{bmatrix} = \begin{bmatrix} C_{1,2} & \dots & C_{1,N+K} \\ \vdots & \ddots & \vdots \\ C_{M,1} & \dots & C_{M,N+K} \end{bmatrix} \cdot \begin{bmatrix} X_1 \\ \vdots \\ X_{N+K} \end{bmatrix} = C \cdot \vec{X} \quad \text{(Equation 8)}$$

$$\text{for } 1 \le K \le (M - N)$$

In Equation 8, $\vec{X}$ represents a column vector corresponding to N+K signals obtained from the N intermediate input signals; C represents an M×(N+K) matrix or array of mixing coefficients; and $\vec{Y}$ represents a column vector corresponding to the M intermediate output signals. The mixing operation may be performed on signals represented in the time domain or frequency domain. The following discussion makes more particular mention of time-domain implementations.

As shown in expression 1, K is greater than or equal to one and less than or equal to the difference (M−N). As a result, the number of signals $X_i$ and the number of columns in the matrix C is between N+1 and M. The coefficients of the matrix C may be obtained from a set of N+K unit-magnitude vectors in an M-dimensional space that are substantially orthogonal to one another. As noted above, two vectors are considered to be "substantially orthogonal" to one another if their dot product is less than 35% of a product of their magnitudes.

Each column in the matrix C may have M coefficients that correspond to the elements of one of the vectors in the set. For example, the coefficients that are in the first column of the matrix C correspond to one of the vectors V in the set whose elements are denoted as ($V_1$, . . . , $V_M$) such that $C_{1,1}=p \cdot V_1$, . . . , $C_{M,1}=p \cdot V_M$, where p represents a scale factor used to scale the matrix coefficients as may be desired. Alternatively, the coefficients in each column j of the matrix C may be scaled by different scale factors $p_j$. In many applications, the coefficients are scaled so that the Frobenius norm of the matrix is equal to or within 10% of $\sqrt{N}$. Additional aspects of scaling are discussed below.

The set of N+K vectors may be derived in any way that may be desired. One method creates an M×M matrix G of coefficients with pseudo-random values having a Gaussian distribution, and calculates the singular value decomposition of this matrix to obtain three M×M matrices denoted here as U, S and V. The U and V matrices may both be unitary matrices. The C matrix can be obtained by selecting N+K columns from either the U matrix or the V matrix and scaling the coefficients in these columns to achieve a Frobenius norm equal to or within 10% of $\sqrt{N}$. A method that relaxes some of the requirements for orthogonality is described below.

The numerical correlation of two signals can be calculated using a variety of known numerical algorithms. These algorithms yield a measure of numerical correlation called a correlation coefficient that varies between negative one and positive one. A correlation coefficient with a magnitude equal to or close to one indicates the two signals are closely related. A correlation coefficient with a magnitude equal to or close to zero indicates the two signals are generally independent of each other.

The N+K input signals may be obtained by decorrelating the N intermediate input signals with respect to each other. In some implementations, the decorrelation may be what is referred to herein as "psychoacoustic decorrelation," which is discussed briefly above. Psychoacoustic decorrelation is less stringent than numerical decorrelation in that two signals may be considered psychoacoustically decorrelated even if they have some degree of numerical correlation with each other.

Psychoacoustic decorrelation can be achieved using delays or other types of filters, some of which are described below. In many implementations, N of the N+K signals X, can be taken directly from the N intermediate input signals without using any delays or filters to achieve psychoacoustic decorrelation because these N signals represent a diffuse sound field and are likely to be already psychoacoustically decorrelated.

Second Derivation Method

If the signals generated by the diffuse signal processor 40 are combined with other signals representing a non-diffuse sound field according to the first derivation method described above, the resulting combination of signals may sometimes generate undesirable artifacts. In some instances, these artifacts may result because the design of the matrix C did not properly account for possible interactions between the diffuse and non-diffuse portions of a sound field. As mentioned above, the distinction between diffuse and non-diffuse is not always definite. For example, referring to FIG. 4A, the input signal analyzer 20 may generate some signals along the path 28 that represent, to some degree, a diffuse sound field and may generate signals along the path 29 that represent a non-diffuse sound field to some degree. If the diffuse signal generator 40 destroys or modifies the non-diffuse character of the sound field represented by the signals on the path 29, undesirable artifacts or audible distortions may occur in the sound field that is produced from the output signals generated along the path 59. For example, if the sum of the M diffuse processed signals on the path 49 with the M non-diffuse processed signals on the path 39 causes cancellation of some non-diffuse signal components, this may degrade the subjective impression that would otherwise be achieved.

An improvement may be achieved by designing the matrix C to account for the non-diffuse nature of the sound field that is processed by the non-diffuse signal processor 30. This can be done by first identifying a matrix E that either represents, or is assumed to represent, the encoding processing that processes M channels of audio signals to create the N channels of input audio signals received from the path 19, and then deriving an inverse of this matrix, e.g., as discussed below.

One example of a matrix E is a 5×2 matrix that is used to downmix five channels, L, C, R, LS, RS, into two channels denoted as left-total ($L_T$) and right total ($R_T$). Signals for the $L_T$ and $R_T$ channels are one example of the input audio signals for two (N=2) channels that are received from the path 19. In this example, the device 10 may be used to synthesize five (M=5) channels of output audio signals that can create a sound field that is perceptually similar to (if not substantially identical to) the sound field that could have been created from the original five audio signals.

An example of a 5×2 matrix E that may be used to encode $L_T$ and $R_T$ channel signals from the L, C, R, LS and RS channel signals is shown in the following expression:

$$E = \begin{bmatrix} 1 & \frac{\sqrt{2}}{2} & 0 & \frac{\sqrt{3}}{2} & \frac{-1}{2} \\ 0 & \frac{\sqrt{2}}{2} & 1 & \frac{-1}{2} & \frac{\sqrt{3}}{2} \end{bmatrix} \quad \text{(Equation 9)}$$

An M×N pseudoinverse matrix B may be derived from the N×M matrix E using known numerical techniques, such as those implemented in numerical software such as the "piny" function in Matlab®, available from The MathWorks™, Natick, Mass., or the "PseudoInverse" function in Mathematica®, available from Wolfram Research, Champaign, Ill. The matrix B may not be optimum if its coefficients create unwanted crosstalk between any of the channels, or if any coefficients are imaginary or complex numbers. The matrix B can be modified to remove these undesirable characteristics. The matrix B can also be modified to achieve a variety of desired artistic effects by changing the coefficients to emphasize the signals for selected speakers. For example, coefficients can be changed to increase the energy in signals destined for play back through speakers for left and right channels and to decrease the energy in signals destined for play back through the speaker(s) for the center channel. The coefficients in the matrix B may be scaled so that each column of the matrix represents a unit-magnitude vector in an M-dimensional space. The vectors represented by the columns of the matrix B do not need to be substantially orthogonal to one another.

One example of a 5×2 matrix B is shown in the following expression:

$$B = \begin{bmatrix} 0.65 & 0 \\ 0.40 & 0.40 \\ 0 & 0.65 \\ 0.60 & -0.24 \\ -0.24 & 0.60 \end{bmatrix} \quad \text{(Equation 10)}$$

A matrix such as that of Equation 10 may be used to generate a set of M intermediate output signals from the N intermediate input signals by the following operation:

$$\vec{Y} = B \cdot \vec{X} \quad \text{(Equation 11)}$$

Figure 7:
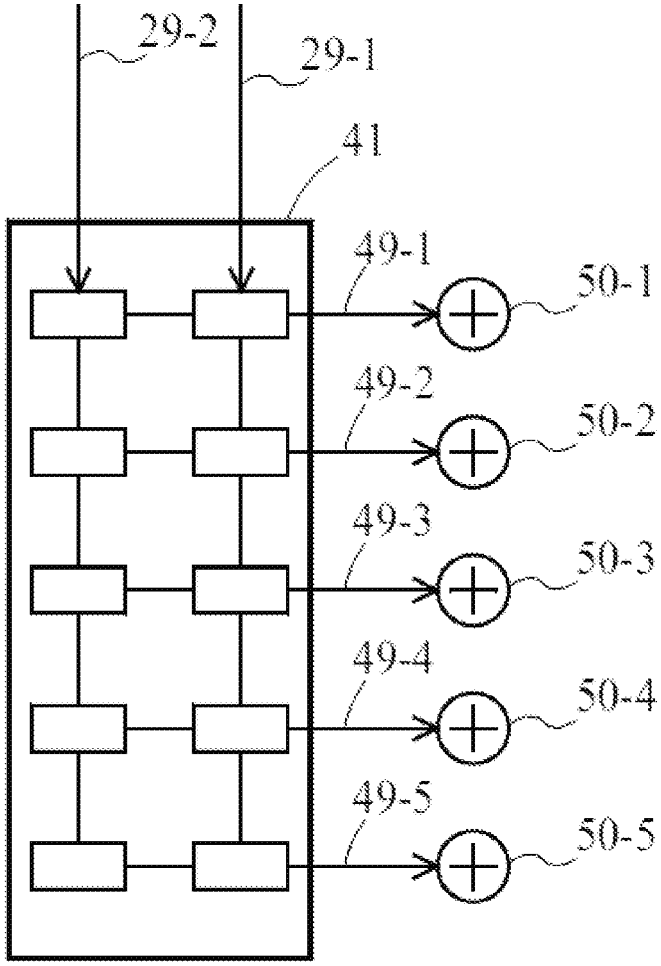
FIG. 7 is a block diagram of an apparatus capable of generating a set of M intermediate output signals from N intermediate input signals.

FIG. 7 is a block diagram of an apparatus capable of generating a set of M intermediate output signals from N intermediate input signals. The upmixer 41 may, for example, be a component of the diffuse signal processor 40, e.g. as shown in FIG. 4A. In this example, the upmixer 41 receives the N intermediate input signals from the signal paths 29-1 and 29-2 and mixes these signals according to a system of linear equations to generate a set of M intermediate output signals along the signal paths 49-1 to 49-5. The boxes within the upmixer 41 represent signal multiplication or amplification by coefficients of the matrix B according to the system of linear equations.

Although the matrix B can be used alone, performance may be improved by using an additional M×K augmentation matrix A, where $1 \le K \le (M-N)$. Each column in the matrix A may represent a unit-magnitude vector in an M-dimensional space that is substantially orthogonal to the vectors represented by the N columns of matrix B. If K is greater than one, each column may represent a vector that is also substantially orthogonal to the vectors represented by all other columns in the matrix A.

The vectors for the columns of the matrix A may be derived in a variety of ways. For example, the techniques mentioned above may be used. Other methods involve scaling the coefficients of the augmentation matrix A and the matrix B, e.g., as explained below, and concatenating the coefficients to produce the matrix C. In one example, the scaling and concatenation may be expressed algebraically as:

$$C = [\beta \cdot B | \alpha \cdot A] \quad \text{(Equation 12)}$$

In Equation 12, "|" represents a horizontal concatenation of the columns of matrix B and matrix A, α represents a scale factor for the matrix A coefficients, and β represents a scale factor for the matrix B coefficients.

In some implementations, the scale factors α and β may be chosen so that the Frobenius norm of the composite matrix C is equal to or within 10% of the Frobenius norm of the matrix B. The Frobenius norm of the matrix C may be expressed as:

$$\|C\|_F = \sqrt{\Sigma_i \Sigma_j |c_{ij}|^2} \quad \text{(Equation 13)}$$

In Equation 13, $c_{i,j}$ represents the matrix coefficient in row i and column j.

If each of the N columns in the matrix B and each of the K columns in the matrix A represent a unit-magnitude vector, the Frobenius norm of the matrix B is equal to $\sqrt{N}$ and the Frobenius norm of the matrix A is equal to $\sqrt{K}$. For this case, it can be shown that if the Frobenius norm of the matrix C is to be set equal to $\sqrt{N}$, then the values for the scale factors α and β are related to one another as shown in the following expression:

$$\alpha = \sqrt{\frac{N \cdot (1 - \beta^2)}{K}} \quad \text{(Equation 14)}$$

After setting the value of the scale factor β, the value for the scale factor α can be calculated from Equation 14. In some implementations, the scale factor β may be selected so that the signals mixed by the coefficients in columns of the matrix B are given at least 5 dB greater weight than the signals mixed by coefficients in columns of the augmentation matrix A. A difference in weight of at least 6 dB can be achieved by constraining the scale factors such that $\alpha < \frac{1}{2}\beta$. Greater or lesser differences in scaling weight for the columns of the matrix B and the matrix A may be used to achieve a desired acoustical balance between audio channels.

Alternatively, the coefficients in each column of the augmentation matrix A may be scaled individually as shown in the following expression:

$$C = [\beta \cdot B | \alpha_1 \cdot A_1 \ \alpha_2 \cdot A_2 \ldots \alpha_K \cdot A_K] \quad \text{(Equation 15)}$$

In Equation 15, $A_j$ represents column j of the augmentation matrix A and $\alpha_j$ represents the respective scale factor for column j. For this alternative, we may choose arbitrary values for each scale factor $\alpha_j$, provided that each scale factor satisfies the constraint $\alpha_j < \frac{1}{2}\beta$. In some implementations, the values of the αj and β coefficients are chosen to ensure that the Frobenius norm of C is approximately equal to the Frobenius norm of the matrix B.

Figure 8:
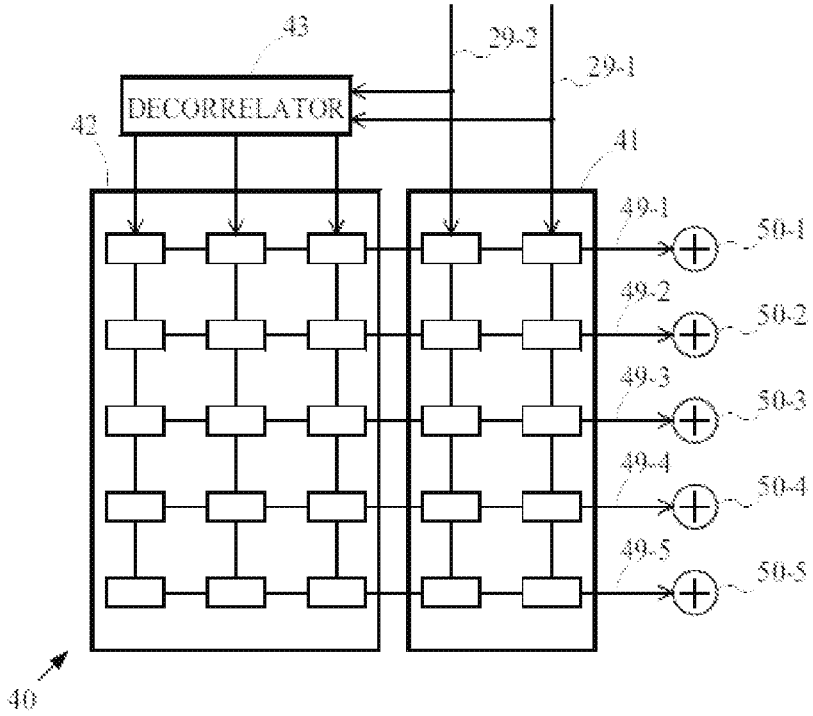
FIG. 8 is a block diagram that shows an example of decorrelating selected intermediate signals.

Each of the signals that are mixed according to the augmentation matrix A may be processed so that they are psychoacoustically decorrelated from the N intermediate input signals and from all other signals that are mixed according to the augmentation matrix A. FIG. 8 is a block diagram that shows an example of decorrelating selected intermediate signals. In this example, two (N=2) intermediate input signals, five (M=5) intermediate output signals and three (K=3) decorrelated signals are mixed according to the augmentation matrix A. In the example shown in FIG. 8, the two intermediate input signals are mixed according to the basic inverse matrix B, represented by block 41. The two intermediate input signals are decorrelated by the decorrelator 43 to provide three decorrelated signals that are mixed according to the augmentation matrix A, which is represented by block 42.

Figure 9:
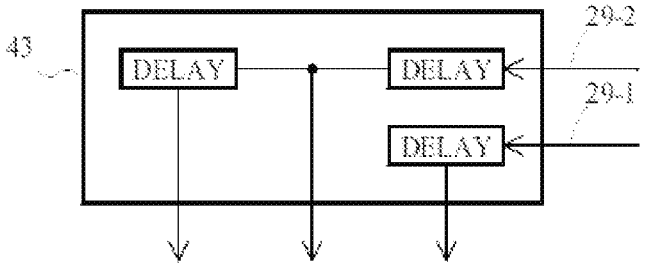
FIG. 9 is a block diagram that shows an example of decorrelator components.

The decorrelator 43 may be implemented in a variety of ways. FIG. 9 is a block diagram that shows an example of decorrelator components. The implementation shown in FIG. 9 is capable of achieving psychoacoustic decorrelation by delaying input signals by varying amounts. Delays in the range from one to twenty milliseconds are suitable for many applications.

Figure 10:
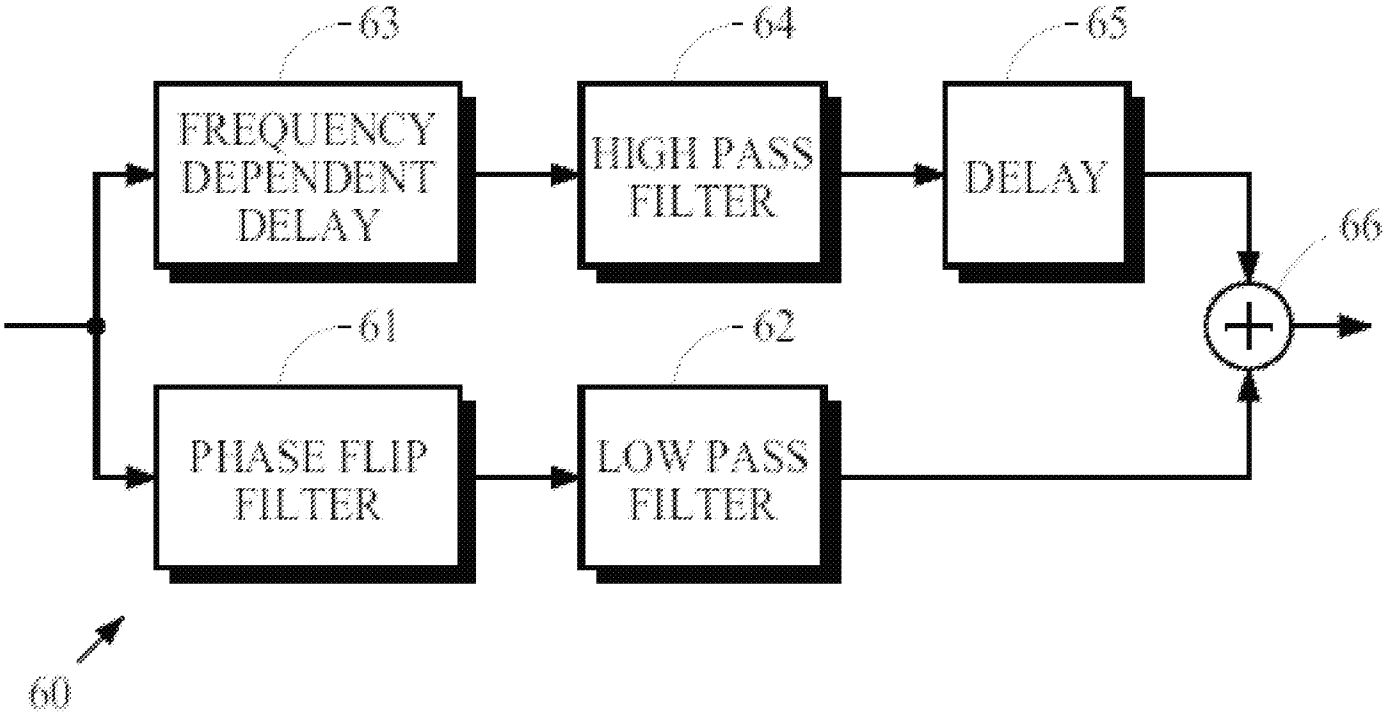
FIG. 10 is a block diagram that shows an alternative example of decorrelator components.

FIG. 10 is a block diagram that shows an alternative example of decorrelator components. In this example, one of the intermediate input signals is processed. An intermediate input signal is passed along two different signal-processing paths that apply filters to their respective signals in two overlapping frequency subbands. The lower-frequency path includes a phase-flip filter 61 that filters its input signal in a first frequency subband according to a first impulse response and a low pass filter 62 that defines the first frequency subband. The higher-frequency path includes a frequency-dependent delay 63 implemented by a filter that filters its input signal in a second frequency subband according to a second impulse response that is not equal to the first impulse response, a high pass filter 64 that defines the second frequency subband and a delay component 65. The outputs of the delay 65 and the low pass filter 62 are combined in the summing node 66. The output of the summing node 66 is a signal that is psychoacoustically decorrelated with respect to the intermediate input signal.

The phase response of the phase-flip filter 61 may be frequency-dependent and may have a bimodal distribution in frequency with peaks substantially equal to positive and negative ninety degrees. An ideal implementation of the phase-flip filter 61 has a magnitude response of unity and a phase response that alternates or flips between positive ninety degrees and negative ninety degrees at the edges of two or more frequency bands within the passband of the filter. A phase-flip may be implemented by a sparse Hilbert transform that has an impulse response shown in the following expression:

$$H_s(k) = \begin{cases} 2/k'\pi & \{\text{odd } k' = k/S\} \\ 0 & [\text{otherwise}\} \end{cases} \quad \text{(Equation 16)}$$

The impulse response of the sparse Hilbert transform is preferably truncated to a length selected to optimize decorrelator performance by balancing a tradeoff between transient performance and smoothness of the frequency response. The number of phase flips may be controlled by the value of the S parameter. This parameter should be chosen to balance a tradeoff between the degree of decorrelation and the impulse response length. A longer impulse response may be required as the S parameter value increases. If the S parameter value is too small, the filter may provide insufficient decorrelation. If the S parameter is too large, the filter may smear transient sounds over an interval of time sufficiently long to create objectionable artifacts in the decorrelated signal.

The ability to balance these characteristics can be improved by implementing the phase-flip filter 21 to have a non-uniform spacing in frequency between adjacent phase flips, with a narrower spacing at lower frequencies and a wider spacing at higher frequencies. In some implementations, the spacing between adjacent phase flips is a logarithmic function of frequency.

The frequency dependent delay 63 may be implemented by a filter that has an impulse response equal to a finite length sinusoidal sequence h[n] whose instantaneous frequency decreases monotonically from $\pi$ to zero over the duration of the sequence. This sequence may be expressed as:

$$h[n]=G\sqrt{|\omega'(n)|}\cos(\phi(n)),\ \text{for } 0\le n<L \quad \text{(Equation 17)}$$

In Equation 17, $\omega(n)$ represents the instantaneous frequency, $\omega'(n)$ represents the first derivative of the instantaneous frequency, G represents a normalization factor, $\phi(n)=\int_0^n\omega(t)dt$ represents an instantaneous phase, and L represents the length of the delay filter. In some examples, the normalization factor G may be set to a value such that:

$$\sum_{n=0}^{L-1} h^2[n] = 1 \quad \text{(Equation 18)}$$

A filter with this impulse response can sometimes generate "chirping" artifacts when it is applied to audio signals with transients. This effect can be reduced by adding a noise-like term to the instantaneous phase term as shown in the following expression:

$$h[n]=G\sqrt{\omega'(n)}\cos(\phi(n)+N(n)),\ \text{for } 0\le n<L \quad \text{(Equation 19)}$$

If the noise-like term is a white Gaussian noise sequence with a variance that is a small fraction of $\pi$, the artifacts that are generated by filtering transients will sound more like noise rather than chirps and the desired relationship between delay and frequency may still be achieved.

The cut off frequencies of the low pass filter 62 and the high pass filter 64 may be chosen to be approximately 2.5 kHz, so that there is no gap between the passbands of the two filters and so that the spectral energy of their combined outputs in the region near the crossover frequency where the passbands overlap is substantially equal to the spectral energy of the intermediate input signal in this region. The amount of delay imposed by the delay 65 may be set so that the propagation delay of the higher-frequency and lower-frequency signal processing paths are approximately equal at the crossover frequency.

The decorrelator may be implemented in different ways. For example, either one or both of the low pass filter 62 and the high pass filter 64 may precede the phase-flip filter 61 and the frequency-dependent delay 63, respectively. The delay 65 may be implemented by one or more delay components placed in the signal processing paths as desired.

Figure 11:
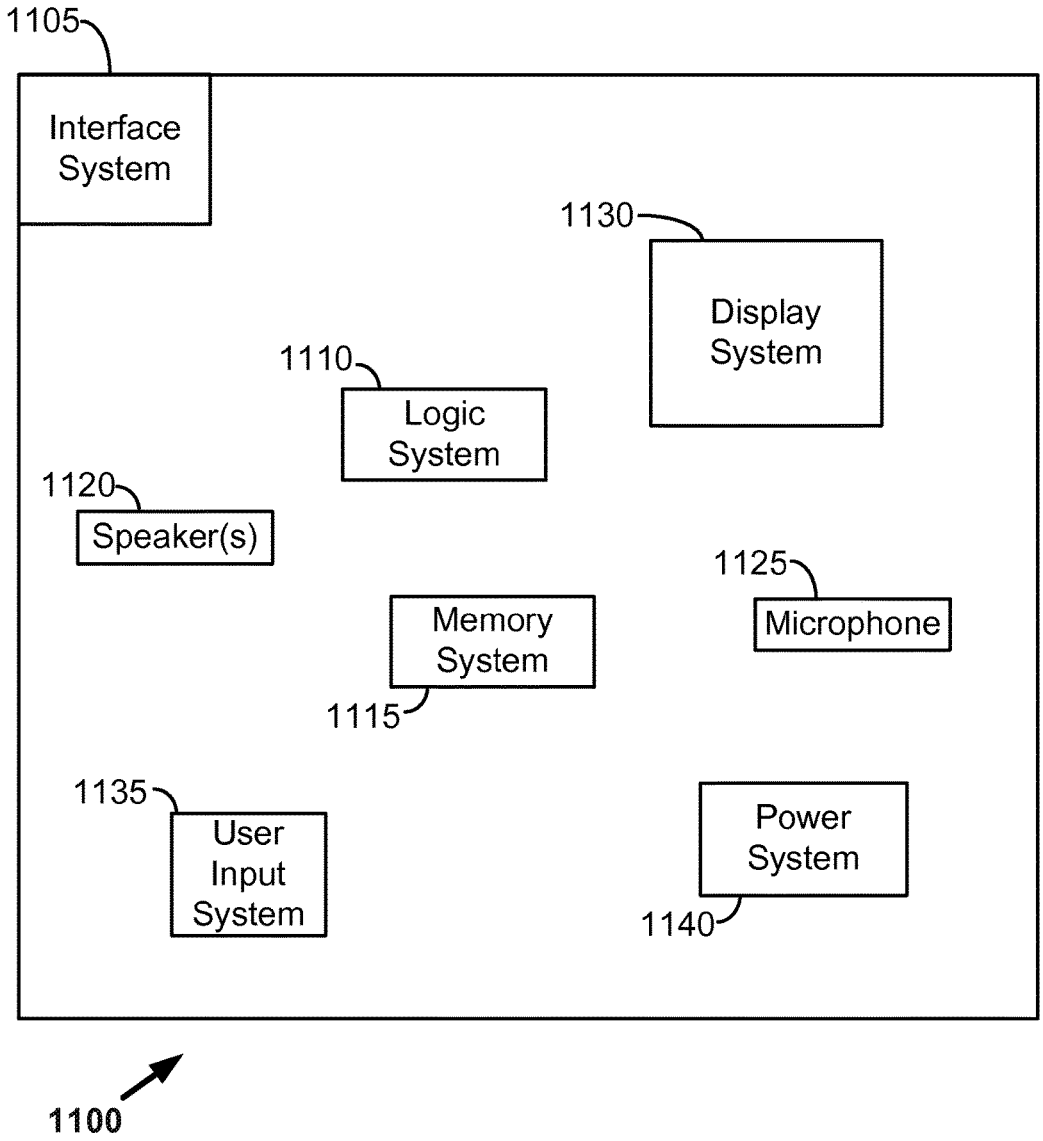
FIG. 11 is a block diagram that provides examples of components of an audio processing apparatus.

FIG. 11 is a block diagram that provides examples of components of an audio processing system. In this example, the audio processing system 1100 includes an interface system 1105. The interface system 1105 may include a network interface, such as a wireless network interface. Alternatively, or additionally, the interface system 1105 may include a universal serial bus (USB) interface or another such interface.

The audio processing system 1100 includes a logic system 1110. The logic system 1110 may include a processor, such as a general purpose single- or multi-chip processor. The logic system 1110 may include a digital signal processor (DSP), an application specific integrated circuit (ASIC), a field programmable gate array (FPGA) or other programmable logic device, discrete gate or transistor logic, or discrete hardware components, or combinations thereof. The logic system 1110 may be configured to control the other components of the audio processing system 1100. Although no interfaces between the components of the audio processing system 1100 are shown in FIG. 11, the logic system 1110 may be configured with interfaces for communication with the other components. The other components may or may not be configured for communication with one another, as appropriate.

The logic system 1110 may be configured to perform audio processing functionality, including but not limited to the types of functionality described herein. In some such implementations, the logic system 1110 may be configured to operate (at least in part) according to software stored on one or more non-transitory media. The non-transitory media may include memory associated with the logic system 1110, such as random access memory (RAM) and/or read-only memory (ROM). The non-transitory media may include memory of the memory system 1115. The memory system 1115 may include one or more suitable types of non-transitory storage media, such as flash memory, a hard drive, etc.

The display system 1130 may include one or more suitable types of display, depending on the manifestation of the audio processing system 1100. For example, the display system 1130 may include a liquid crystal display, a plasma display, a bistable display, etc.

The user input system 1135 may include one or more devices configured to accept input from a user. In some implementations, the user input system 1135 may include a touch screen that overlays a display of the display system 1130. The user input system 1135 may include a mouse, a track ball, a gesture detection system, a joystick, one or more GUIs and/or menus presented on the display system 1130, buttons, a keyboard, switches, etc. In some implementations, the user input system 1135 may include the microphone 1125: a user may provide voice commands for the audio processing system 1100 via the microphone 1125. The logic system may be configured for speech recognition and for controlling at least some operations of the audio processing system 1100 according to such voice commands. In some implementations, the user input system 1135 may be considered to be a user interface and therefore as part of the interface system 1105.

The power system 1140 may include one or more suitable energy storage devices, such as a nickel-cadmium battery or a lithium-ion battery. The power system 1140 may be configured to receive power from an electrical outlet.

Various modifications to the implementations described in this disclosure may be readily apparent to those having ordinary skill in the art. The general principles defined herein may be applied to other implementations without departing from the spirit or scope of this disclosure. Thus, the claims are not intended to be limited to the implementations shown herein, but are to be accorded the widest scope consistent with this disclosure, the principles and the novel features disclosed herein.

What is claimed is:

1. A method for deriving M diffuse audio signals from N audio signals for presentation of a diffuse sound field, wherein M is greater than N and is greater than 2, and wherein the method comprises:

receiving the N audio signals, wherein each of the N audio signals corresponds to a spatial location;

deriving diffuse portions of the N audio signals;

detecting instances of transient audio signal conditions; and processing the diffuse portions of the N audio signals to derive the M diffuse audio signals, wherein during instances of transient audio signal conditions the processing comprises distributing the diffuse portions of the N audio signals in greater proportion to one or more of the M diffuse audio signals corresponding to spatial locations relatively nearer to the spatial locations of the N audio signals and in lesser proportion to one or more of the M diffuse audio signals corresponding to spatial locations relatively further from the spatial locations of the N audio signals.

2. The method of claim 1, further comprising detecting instances of non-transient audio signal conditions, wherein during instances of non-transient audio signal conditions the processing involves distributing the diffuse portions of the N audio signals to the M diffuse audio signals in a substantially uniform manner.

3. The method of claim 2, wherein the processing involves applying a mixing matrix to the diffuse portions of the N audio signals to derive the M diffuse audio signals.

4. The method of claim 3, wherein the mixing matrix is a variable distribution matrix that is derived from a non-transient matrix more suitable for use during non-transient audio signal conditions and a transient matrix more suitable for use during transient audio signal conditions.

5. The method of claim 4, further comprising determining a transient control signal value, wherein the variable distribution matrix is derived by interpolating between the transient matrix and the non-transient matrix based, at least in part, on the transient control signal value.

6. The method of claim 5, wherein the transient control signal value is time-varying, can vary in a continuous manner from a minimum to a maximum value, or can vary in a range of discrete values from a minimum value to a maximum value.

7. The method of claim 5, further comprising deriving the transient control signal value in response to the N audio signals; and/or wherein determining the variable distribution matrix involves computing the variable distribution matrix according to the transient control signal value, or retrieving a stored variable distribution matrix from a memory device.

8. The method of claim 1, wherein the method further comprises:

deriving K intermediate signals from the diffuse portions of the N audio signals such that each intermediate audio signal is psychoacoustically decorrelated with the diffuse portions of the N audio signals and, if K is greater than one, is psychoacoustically decorrelated with all other intermediate audio signals, wherein K is greater than or equal to one and is less than or equal to M−N.

9. The method of claim 8, wherein deriving the K intermediate signals involves a decorrelation process that includes one or more of delays, all-pass filters, pseudo-random filters or reverberation algorithms, and/or wherein the M diffuse audio signals are derived in response to the K intermediate signals as well as the N diffuse signals.

10. An apparatus, comprising:

an interface system; and a logic system capable of:

receiving, via the interface system, N input audio signals, wherein each of the N audio signals corresponds to a spatial location;

deriving diffuse portions of the N audio signals;

detecting instances of transient audio signal conditions; and processing the diffuse portions of the N audio signals to derive M diffuse audio signals, wherein M is greater than N and is greater than 2, and wherein during instances of transient audio signal conditions the processing comprises distributing the diffuse portions of the N audio signals in greater proportion to one or more of the M diffuse audio signals corresponding to spatial locations relatively nearer to the spatial locations of the N audio signals and in lesser proportion to one or more of the M diffuse audio signals corresponding to spatial locations relatively further from the spatial locations of the N audio signals.

11. The apparatus of claim 10, wherein the logic system is capable of detecting instances of non-transient audio signal conditions and wherein during instances of non-transient audio signal conditions the processing involves distributing the diffuse portions of the N audio signals to the M diffuse audio signals in a substantially uniform manner.

12. The apparatus of claim 11, wherein the processing involves applying a mixing matrix to the diffuse portions of the N audio signals to derive the M diffuse audio signals.

13. The apparatus of claim 12, wherein the mixing matrix is a variable distribution matrix that is derived from a non-transient matrix more suitable for use during non-transient audio signal conditions and a transient matrix more suitable for use during transient audio signal conditions.

14. The apparatus of claim 13, wherein the transient matrix is derived from the non-transient matrix.

15. The apparatus of claim 14, wherein each element of the transient matrix represents a scaling of a corresponding non-transient matrix element.

16. The apparatus of claim 15, wherein the scaling is a function of a relationship between an input channel location and an output channel location.

17. The apparatus of claim 13, wherein the logic system is capable of determining a transient control signal value, wherein the variable distribution matrix is derived by interpolating between the transient matrix and the non-transient matrix based, at least in part, on the transient control signal value.

18. The apparatus of claim 10, wherein the logic system is capable of:

transforming each of the N audio signals into B frequency bands; and performing the deriving, detecting and processing separately for each of the B frequency bands.

19. The apparatus of claim 10, wherein the logic system is capable of:

panning non-diffuse portions of the N input audio signals to form M non-diffuse audio signals; and combining the M diffuse audio signals with the M non-diffuse audio signals to form M output audio signals.

20. A non-transitory medium having software stored thereon, the software including instructions for controlling at least one apparatus to:

receive N input audio signals, wherein each of the N audio signals corresponds to a spatial location;

derive diffuse portions of the N audio signals;

detect instances of transient audio signal conditions; and process the diffuse portions of the N audio signals to derive M diffuse audio signals, wherein M is greater than N and is greater than 2, and wherein during instances of transient audio signal conditions the processing comprises distributing the diffuse portions of the N audio signals in greater proportion to one or more of the M diffuse audio signals corresponding to spatial locations relatively nearer to the spatial locations of the N audio signals and in lesser proportion to one or more of the M diffuse audio signals corresponding to spatial locations relatively further from the spatial locations of the N audio signals.

* * * * *